US009371608B2

(12) United States Patent
Cho et al.

(10) Patent No.: US 9,371,608 B2
(45) Date of Patent: Jun. 21, 2016

(54) LAUNDRY TREATMENT APPARATUS

(71) Applicant: LG Electronics Inc., Seoul (KR)

(72) Inventors: Hongjun Cho, Seoul (KR); Sanghun Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/625,130

(22) Filed: Feb. 18, 2015

(65) Prior Publication Data

US 2015/0233039 A1 Aug. 20, 2015

(30) Foreign Application Priority Data

Feb. 18, 2014 (KR) ..... 10-2014-0018458

(51) Int. Cl.

*D06F 37/26* (2006.01)
*D06F 37/22* (2006.01)
*D06F 39/14* (2006.01)

(52) U.S. Cl.

CPC ..... *D06F 37/225* (2013.01); *D06F 37/26* (2013.01); *D06F 37/268* (2013.01); *D06F 39/14* (2013.01)

(58) Field of Classification Search

CPC ..... D06F 37/10; D06F 37/18; D06F 37/28; D06F 39/14

See application file for complete search history.

(56) References Cited

U.S. PATENT DOCUMENTS 3,018,508 A * 1/1962 Keeling, Sr. ..... E05D 15/52 126/194
3,327,700 A * 6/1967 MacAulay ..... F24C 15/023 126/191
3,698,781 A * 10/1972 Dunn ..... D06F 39/14 126/194
4,088,861 A * 5/1978 Zwillinger ..... F24C 15/023 126/191
8,955,352 B2 * 2/2015 Lee ..... F25D 23/02 312/273
2012/0161594 A1 * 6/2012 Kim ..... D06F 39/14 312/228
2012/0187811 A1 * 7/2012 Kim ..... D06F 33/02 312/228
2012/0217851 A1 * 8/2012 Bae ..... D06F 37/28 312/222
2013/0193823 A1 * 8/2013 Cho ..... D06F 39/14 312/319.2
2015/0233038 A1 * 8/2015 Lee ..... D06F 37/225 312/228
2015/0233042 A1 * 8/2015 Kang ..... D06F 39/12 312/228
2015/0233043 A1 * 8/2015 Sim ..... D06F 39/12 312/228

* cited by examiner

*Primary Examiner* — Daniel Rohrhoff
(74) *Attorney, Agent, or Firm* — Dentons US LLP

(57) ABSTRACT

A laundry treatment apparatus including a cabinet comprising a front panel having a laundry introduction hole formed therein, a laundry accommodating unit provided in the cabinet including a predetermined space in which laundry introduced through the laundry introduction hole is held, a door which is coupled to the front panel and rotatable about a horizontal axis parallel to a bottom surface of the cabinet to open and close the laundry introduction hole, and a damper provided in the front panel and upwardly inclined with respect to the bottom surface of the cabinet, to elastically support the door.

14 Claims, 7 Drawing Sheets

(a)

(b)

(a)

(b)

LAUNDRY TREATMENT APPARATUS

CROSS-REFERENCE TO RELATED APPLICATIONS

Pursuant to 35 U.S.C. §119(a), this application claims the benefit of earlier filing date and right of priority to Korean Application No. 10-2014-0018458, filed on Feb. 18, 2014, the entire contents of which is hereby incorporated by reference herein in its entirety.

BACKGROUND

1. Field

Embodiments of the present disclosure relate to a laundry treatment apparatus.

2. Discussion of the Related Art

A laundry treatment apparatus is a generic term for electric home appliances used in washing, drying, or washing and drying clothes.

In a laundry treatment apparatus, a washing process removes dirt from clothes, using the action of water and detergent, and a drying process dries moisture contained in the clothes, using a heated air supply mechanism.

A conventional laundry treatment apparatus includes a cabinet forming an exterior appearance of the laundry treatment apparatus, a clothes-accommodating portion provided in the cabinet to receive clothes, a laundry introduction hole provided in the cabinet, in communication with the clothes-accommodating portion, and a door for opening and closing the laundry introduction hole. Meanwhile, the door provided in the conventional laundry treatment apparatus is generally rotatable with respect to a single vertical axis formed along a longitudinal direction of the cabinet.

SUMMARY

Embodiments of the present invention provide a laundry treatment apparatus including a plurality of shafts configured to rotate a door in different directions.

Embodiments of the present disclosure also provide a laundry treatment apparatus enabling a user to select one of shafts.

Embodiments of the present disclosure also provide a laundry treatment apparatus which may control a rotational speed of a door to prevent damage to means for supporting the door and other mechanisms.

Embodiments of the present disclosure also provide a laundry treatment apparatus including a cabinet forming an exterior appearance of the laundry treatment apparatus; a laundry introduction hole formed in the front panel; a laundry accommodating unit provided in the cabinet including a predetermined space in which laundry introduced through the laundry introduction hole is held; a door, coupled to the front panel and rotatable about a horizontal axis parallel to a bottom surface of the cabinet, to open and close the laundry introduction hole; and a damper, provided in the front panel and upwardly inclined with respect to the bottom surface of the cabinet, to elastically support the door.

The door may include an inclined surface provided in a lower end surface of the front panel, the surface being inclined in a direction away from the front panel, wherein the damper supports the inclined surface.

The damper may include a damper housing provided in the front panel; a piston provided to reciprocate along a direction perpendicular to the inclined surface, having one end reciprocating in the damper housing and a free end supporting the inclined surface; and a piston supporter provided in the damper housing to elastically support the piston.

The free end of the piston may be in contact with the door when closing the laundry introduction hole.

The laundry treatment apparatus may further include a first hinge comprising a first shaft provided in the front panel to form a vertical axis perpendicular to the bottom surface of the cabinet and a first shaft accommodating portion provided in the door to accommodate the first shaft; a second hinge comprising a second shaft coupled to the door to form the vertical axis with the first shaft, and a third shaft rotatably coupling the second shaft to a coupling body to form the horizontal axis; a third hinge comprising a fourth shaft provided in the door to form the horizontal axis with the third shaft, and a fourth shaft accommodating portion provided in the front panel to accommodate the fourth shaft; a first bar reciprocating in the door to open and close the first shaft accommodating portion; and a second bar reciprocating in the door to open and close the fourth shaft accommodating portion when the first bar is moved in a direction to open the first shaft accommodating portion.

The door further include an inclined surface provided in a lower end surface of the front panel, the surface being inclined in a direction away from the front panel, wherein the damper may support the inclined surface.

The damper may include a damper housing fixed to a rear surface of the front panel and inclined a preset angle with respect to a line at right angles to the horizontal axis; a piston reciprocating in a direction perpendicular to the inclined surface, comprising one end reciprocating in the damper housing and a free end supporting the inclined surface through the front panel; and a piston supporter provided in the damper housing to elastically support the piston.

The free end of the piston may be in contact with an inclined surface of the door when closing the laundry introduction hole.

The damper may include a damper housing fixed to the front panel; a piston comprising one end reciprocating in the damper housing and a free end supporting the door; and a piston supporter provided in the damper housing to elastically support the piston, and wherein the piston may reciprocate in a direction inclined a preset angle with respect to a line parallel to a bottom surface of the cabinet and lying at right angles to the horizontal axis.

The free end of the piston may be in contact with the door when closing the laundry introduction hole.

The laundry treatment apparatus may further comprise a handle including a handle body, a handle body shaft, a pressure point, and a pressing portion, wherein the handle body shaft is located at one end of the handle body and the pressing portion is located at the opposite end of the handle body with the pressing point lying there between, and wherein operation of the handle requires pressure to be applied to the pressure point.

The laundry treatment apparatus may further comprise a handle including a handle body, a handle body shaft, a pressure point, and a pressing portion, wherein the pressing point is located at one end of the handle body and the pressing portion is located at the opposite end of the handle body with the handle body shaft lying there between, and wherein operation of the handle requires pressure to be applied to the pressure point.

Operation of the handle causes reciprocation of one or more of the first bar and the second bar.

The handle is included in a handle accommodating portion located in the door.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION

Preferred embodiments of the present invention will be described below in more detail with reference to the accompanying drawings. The present invention may, however, be embodied in different forms and should not be constructed as limited to the embodiments set forth herein.

Figure 1:
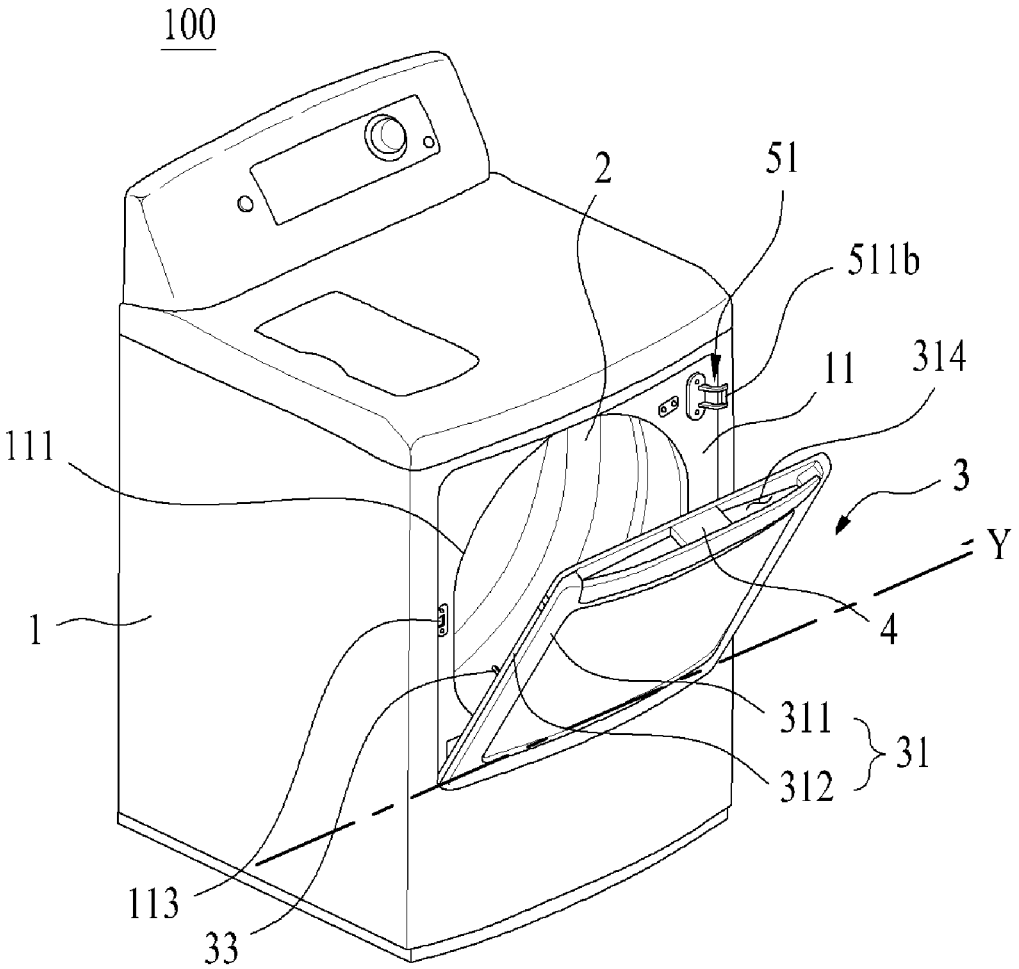
FIGS. 1 and 3 are perspective diagrams of a laundry treatment apparatus in accordance with the present disclosure.

As shown in FIG. 1, a laundry treatment apparatus 100 in accordance with the present disclosure includes a cabinet 1 forming an exterior appearance, a laundry accommodating unit 2 provided in the cabinet to provide a predetermined portion of the laundry treatment apparatus in which clothes (hereinafter, laundry) are loaded, and a door 3 for opening and closing the laundry accommodating unit 2.

Cabinet 1 includes a front panel 11 having an laundry introduction hole 111 formed therein. Door 3 is provided in front panel 11 to open and close the laundry introduction hole 111. Accordingly, a user may open the laundry introduction hole 111, using door 3, to load or unload clothes (i.e., laundry) into or from the laundry accommodating unit 2.

In case laundry treatment apparatus 100 in accordance with the present disclosure is an apparatus for washing clothes, laundry accommodating unit 2 may consist of a tub provided in the cabinet to hold wash water therein and a drum rotatably provided in the tub to define a predetermined portion in which clothes are held.

In this case, the tub has a tub hole in communication with laundry introduction hole 111 and the drum has a drum hole in communication with laundry introduction hole 111.

Laundry treatment apparatus 100 may further include a wash water supply unit (not shown) for supplying wash water to the tub and a wash water exhaustion unit (not shown) for exhausting the wash water held in the tub out of the cabinet 1.

However, in case the laundry treatment apparatus 100 in accordance with the present disclosure is an apparatus only for performing drying, the laundry accommodating unit 2 may consist of only a drum rotatably provided in cabinet 1. In this case, an air supply unit (not shown) may be further provided to supply heated air to the drum and also to exhaust the air supplied to the drum out of the drum.

Meanwhile, laundry treatment apparatus 100 in accordance with the present disclosure may be an apparatus for performing both washing and drying. In this case, the laundry accommodating unit 2 may consist of a tub and a drum. An air supply unit (not shown) may be further provided in the cabinet to supply heated air to the tub and the air out of the tub.

Door 3 provided in front panel 11 to open and close the laundry introduction hole 111 may be rotatable on two rotation axes (X and Y). Door 3 is coupled to front panel 11 on a hinge unit (51, 53, and 55). The user may change the rotation axes (X and Y) of door 3, using handle 4.

Door 3 may include a door body 31 opening and closing the laundry introduction hole 111 and a door lock 33 coupling the door body 31 to front panel 11.

Door body 31 may include an outer frame 311 defining an outer surface of the laundry treatment apparatus 100 and an inner frame 312 disposed in a surface toward the front panel 11, coupled to the outer frame 311.

Door lock 33 may be projected from inner frame 312. A door lock coupling portion 113 may be further provided in front panel 11 to accommodate door lock 33. The structure between door lock 33 and door lock coupling portion 113 may be variable only if it is configured to detachably couple door body 31 to front panel 11.

FIG. 1 shows that door lock 33 includes a bar projected from inner frame 312 and a projection provided in a free end and that the door lock coupling portion 113 is provided in front panel 11 as a groove accommodating the projection.

In addition, a handle accommodating portion 314 is provided in door body 31. FIG. 1 shows that the handle accommodating portion 314 is a groove concavely recessed from a top surface of door body 31. Handle 4 is located in the groove.

Handle 4 may include a handle body 41 provided in the handle accommodating portion 314, a body shaft 43 for rotatably coupling handle body 41 to door body 31 and a pressing portion 45 operating a transition unit 6, which will be described below, based on operation of handle body 41.

Transition unit 6 is provided in door body 31 as means enabling the user to switch one of the rotation axes (X and Y) to the other, which will be described further below.

Figure 2:
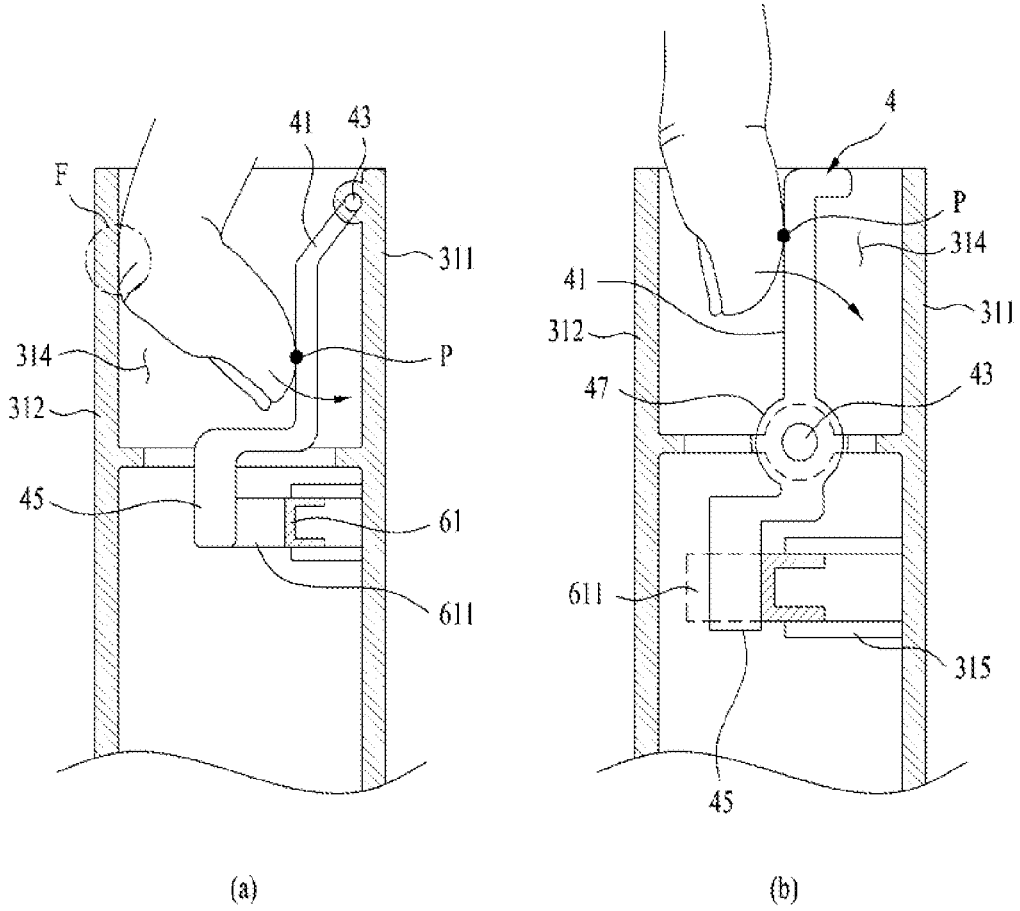
FIG. 2 is a diagram illustrating a handle provided in the laundry treatment apparatus in accordance with the present disclosure.

FIG. 2 (*a*) illustrates body shaft 43 located over a pressure point (P) where body shaft 43 is in contact with the user's finger and handle body 41. FIG. 2 (*b*) illustrates body shaft 43 located under the pressure point (P).

When body shaft 43 is located over the pressure point (see FIG. 2 (*a*)), one end of handle body 41 has to be fixed to the outer frame 311 through body shaft 43 and the pressing portion has to be provided in a free end of handle body 41. Accordingly, handle 4 shown in FIG. 2 (*a*) is required to perform two operations to open the laundry introduction hole 111.

In other words, the user places a finger in the handle accommodating portion 314 and rotates handle body 41 toward outer frame 311, which is a first operation configured to operate transition unit 6 which will be described further herein. The user pulls door body 31 outwardly with respect to front panel 11 and detachably moves door body 31 from front panel 11 in a direction away from front panel 11, which is a second operation configured to open laundry introduction hole 111.

As the space provided by the handle accommodating portion 314 is not particularly wide, the structure of handle 4 shown in FIG. 2 (*a*) could make an inner circumferential surface of the handle accommodating portion 314 restrict (F) the movement of the user's finger and make the user feel uncomfortable in using door 3.

In contrast, the structure of handle 4 shown in FIG. 2 (*b*) enables the user only to pull door body 31 in the direction in which door 3 is away from the front panel 11 so as to open laundry introduction hole 111.

Specifically, handle 4 shown in FIG. 2 (*b*) includes a handle body 41 provided in the handle accommodating portion 314, a shaft accommodating portion 47 fixedly accommodating the handle body therein, a body shaft 43 rotatably coupling shaft accommodating portion 47 to door body 31, and a pressing portion 45 fixed to the shaft accommodating portion 47, located in door body 31. Accordingly, handle body 41 shown in FIG. 2 (*b*) may be rotatable toward outer frame 311 and pressing portion 45 may be rotatable toward inner frame 312.

The direction of handle 4 shown in FIG. 2 (*b*) in which the power is provided to rotate handle body 41 is equal to the direction in which the power is provided to detachably move door body 31 from front panel 11. Accordingly, only when the user pulls door 3 away from the front panel 11 after putting a finger in the handle accommodating portion 314, the user can progress the rotation of handle body 41 and the separation of door body 31 from front panel 11 at the same time.

Handle 4 in accordance with this embodiment may open the door 3 easily, compared with the handle shown in FIG. 2 (*a*) and prevent a disadvantage of the restricted movement of the finger interfered in by the handle accommodating portion 314.

Figure 3:
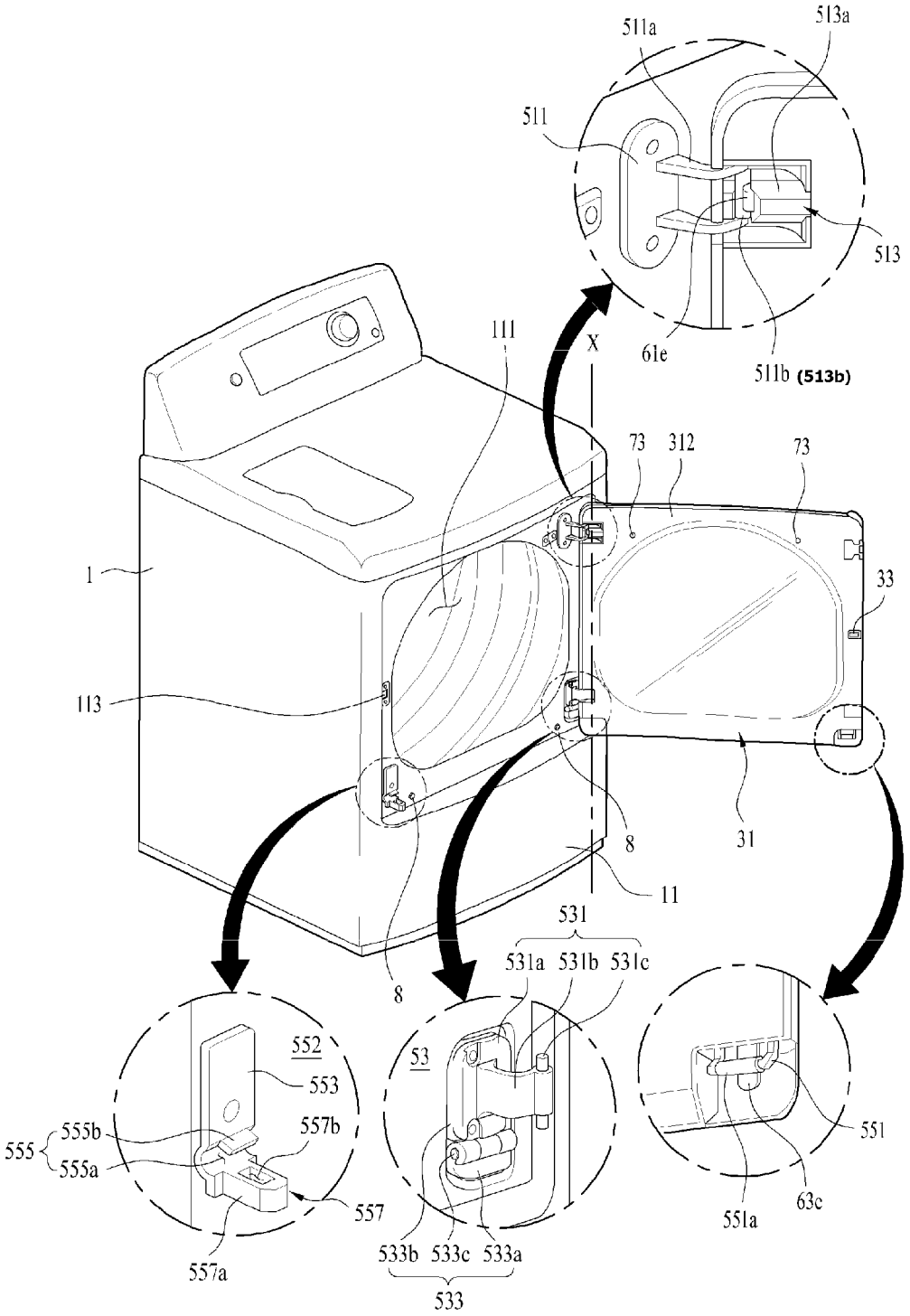

As shown in FIG. 3, the hinge unit 51, 53, and 55 for coupling door body 31 to front panel 11 may consist of a first hinge 51 having a first shaft 511*b*, a third hinge 55 having a fourth shaft 551*a*, and a second hinge 53 having a second shaft 531*c*, forming the first rotation axis (X) together with the first shaft 511*b*, and a third shaft 533*c* forming the second rotation axis (Y, see FIG. 1) together with the fourth shaft 551*a*.

First hinge 51 may be provided in one of the front panel 11 and the door body 31. First hinge 51 may include a first hinge body 511 having first shaft 511*b* formed therein, and a first shaft detaching portion 513 provided in the other one of the front panel 11 and the door body 31. The first shaft detaching portion 513 being detachable from the first shaft 511*b*.

FIG. 3 illustrates that first hinge body 511 is fixed to front panel 11 and that first shaft detaching portion 513 is provided in door body 31.

In this configuration, a shaft supporter 511*a* may be provided in first hinge body 511 to support the first shaft 511*b*. Shaft supporter 511*a* may be projected from front panel 11 and bent in a direction away from laundry introduction hole 111. Alternatively, shaft supporter 511*a* may be only projected from front panel 11.

First shaft detaching portion 513 may include a housing 513*a* provided in door body 31 and a first shaft accommodating portion 513*b* provided in the housing 513*a* to provide a predetermined room in which first shaft 511*b* is accommodated. In this configuration, the first shaft accommodating portion 513*b* may be exposed out of inner frame 312.

Meanwhile, a first bar penetrating hole 513*c* (see FIG. 4) may be provided in housing 513*a* to insert a first bar 61 of transition unit 6 there through along a width direction (W) of door body 31.

When first bar 61 is reciprocated along the width direction (W) of door body 31 by handle 4, a first free end 61*e* of the first bar 61 is exposed to the first shaft accommodating portion 513*b* such that first shaft 511*b* can be prevented from separating from the first shaft accommodating portion 513*b* and such that the first bar 61 inserted in the first bar penetrating hole 513*c* can be in a detachable state from the first shaft accommodating portion 513*b*.

Second hinge 53 may include a door supporter 531 having a second shaft 531*c* coupled to door body 31, and a cabinet coupling portion 533 fixed to front panel 11 to rotatably support door supporter 531 through the third shaft 533*c*.

Cabinet coupling portion 533 may include a coupling body 533*a* fixed to front panel 11 and a rotary plate 533*b* rotatably coupled to coupling body 533*a* through third shaft 533*c*.

Door supporter 531 may include a supporting body 531*a* fixed to rotary plate 533*b* and a shaft supporter 531*b* projected from the supporting body 531*a* to support second shaft 531*c*.

Door body 31 is rotatably coupled to the second shaft 531*c* which is provided in parallel to first shaft 511*b* of first hinge 51, such that the first rotation axis (X) may be formed by first shaft 511*b* and second shaft 531*c*.

Third hinge 55 may include a fourth shaft 551*a* provided in one of door body 31 and front panel 11 and a fourth shaft detaching portion 552 provided in the other one of door body 31 and front panel 11. The fourth shaft 551*a* detachably coupled to the fourth shaft detaching portion 552.

FIG. 3 illustrates that the fourth shaft 551*a* is provided in door body 31 and that the fourth shaft detaching portion 552 is provided in the front panel 11.

The fourth shaft 551*a* may be supported by the third hinge body 551 fixed to door body 31. The fourth shaft 551*a* supported by the third hinge body 551 is exposed out of inner frame 312.

The fourth shaft detaching portion 552 may include a detaching portion body 553 fixed to front panel 11, a fourth shaft accommodating portion 555 provided in the detaching portion body 553 to provide a predetermined space for accommodating the fourth shaft 551*a*, and a bar accommodating portion 557 projected from the detaching portion body 553 to accommodate the second bar 63 of transition unit 6 which will be described later.

Fourth shaft accommodating portion 555 may include an accommodating groove 555*a* concavely recessed from the detaching portion body 553 and a first flange 555*b* extended from the detaching portion body 553 toward accommodating groove 555*a* to support a circumferential surface of the fourth shaft 551*a* inserted in the accommodating groove 555*a*.

Accommodating groove 555*a* is provided in parallel to third shaft 533*c* and when fourth shaft 551*a* is inserted in accommodating groove 555*a* may form the second rotation axis (Y), together with third shaft 533*c*.

Bar accommodating portion 557 may include a second flange 557*a* projected from detaching portion body 553, located under the accommodating groove 555*a* and a flange penetrating hole 557*b* penetrating the second flange 557*a* to insert a first free end 63*e* of second bar 63 reciprocated along a height direction (H) of door body 31 by first bar 61 therein.

Figure 4:
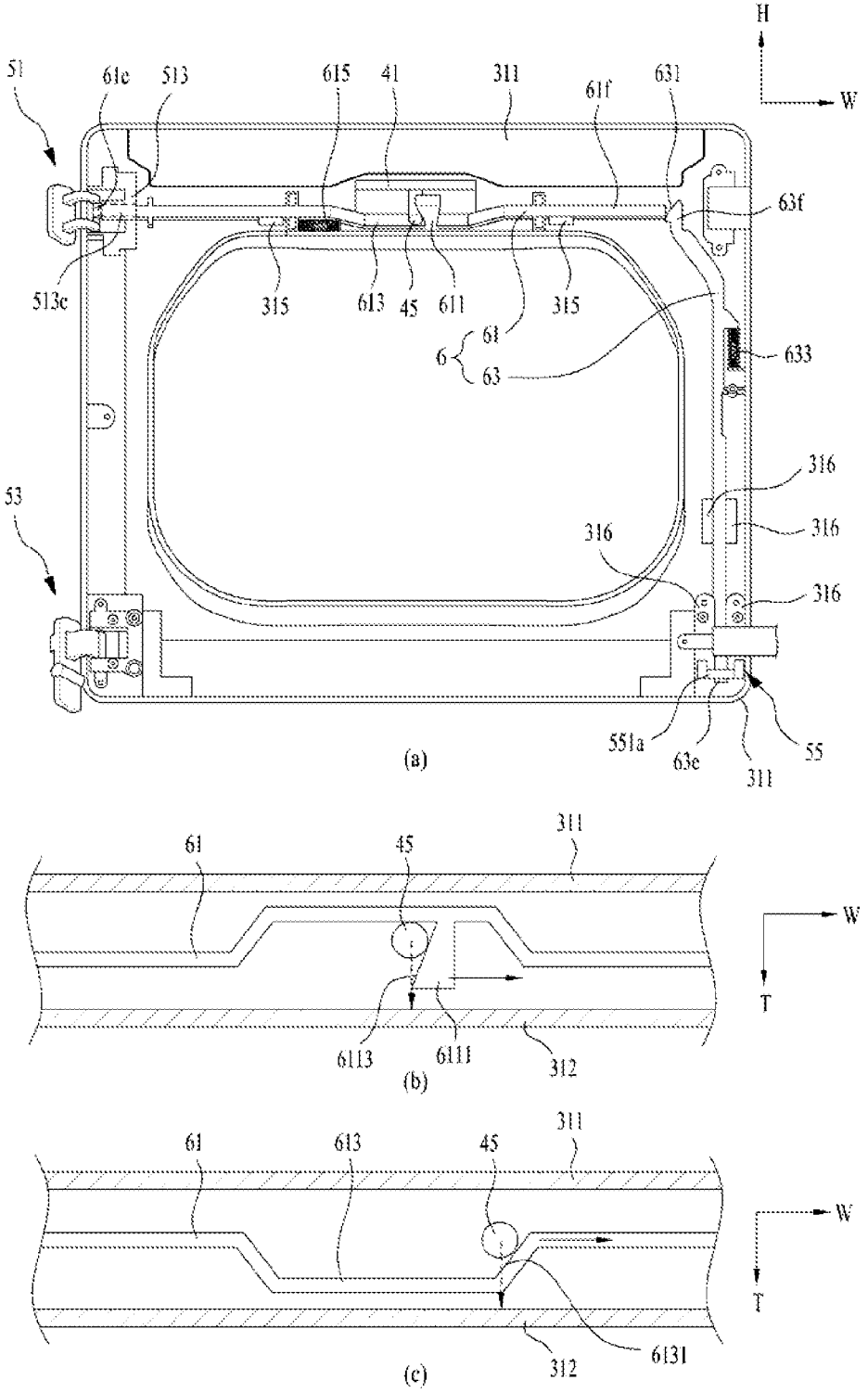
FIG. 4 is a diagram illustrating an inner structure of a door provided in the laundry treatment apparatus in accordance with the present disclosure.

As shown in FIG. 4, transition unit 6 may be provided in door body 31 to enable the user to select one of the rotation axes (X and Y).

Transition unit 6 may include a first bar 61 reciprocating along a wide direction (W) of door body 31 and a second bar 63 reciprocating along a height direction (H) of door body 31.

First bar 61 is provided in an upper portion along the width direction (W) of door body 31 relative to the laundry introduction hole 111. A first free end 61*e* of first bar 61 is inserted in a first bar penetrating hole 513*c* to penetrate the first shaft detaching portion 513 and a second free end 61*f* of the first bar 61 is provided in contact with the second bar 63.

First bar 61 is supported by a first bar guider 315 provided in at least one of the outer and inner frames 311 and 312. FIG.

4 illustrates, as one example, that the first bar guider 315 is provided in the outer frame 311 to guide the movement of the first bar 61.

Meanwhile, first bar 61 is pressed toward the first shaft detaching portion 513 by first supporter 615 provided in door body 31. First supporter 615 has one end fixed to the first bar 61 and the other end fixed to one of the outer and inner frames 311 and 312.

As shown in FIG. 4 (*b*), a contact portion 611 is provided in the first bar 61. Contact portion 611 may be means for moving first bar 61 along a direction toward second bar 63 (i.e., to the right in FIG. 4), when pressing portion 45 of handle 4 is rotated toward inner frame 312.

In other words, the bar contact portion 611 may include a contact portion body 6111 projected from the first bar 61 toward inner frame 312 and an inclined surface 6113 inclined from the contact portion body toward the first free end 61*e*, in contact with pressing portion 45.

Accordingly, when the user presses handle body 41, the pressing portion 45 is moved toward inner frame 312 and the inclined surface 6113 is moved along a direction toward second bar 63 by the pressing portion 45, such that the user can move first bar 61 toward second bar 63, using handle 4.

Meanwhile, bar contact portion 611 is provided in a door body 31 having a restricted thickness. It is preferred that a bend portion 613 bent toward outer frame 311 is further provided in the first bar 61 and that contact portion 611 is provided in bent portion 613.

Alternatively, bent portion 613 as shown in FIG. 4 (*c*) may be bent toward inner frame 613. In this configuration, an inclined surface (6131, a bent portion inclined surface) in contact with pressing portion 45 may be provided in bent portion 613.

When inclined surface 6131 in contact with pressing portion 45 is provided in bent portion 613, the contact portion 611 shown in FIG. 4 (*b*) can be omitted.

Second bar 63 may be provided along the height direction (H) of door body 31. A first free end (63*e*, a third free end) of second bar 63 is located in a predetermined space between the fourth shaft 551*a* and the outer frame 311. A second free end (63*f*, a fourth free end) of second bar 63 is in contact with a second free end 61*f* of first bar 61.

To facilitate transfer of an external force applied to first bar 61 through handle 4 to second bar 63, a bar inclined surface 631 may be further provided in at least one of the second free end 61*f* of the first bar 61 and the second free end 63*f* of the second bar 63. FIG. 4 illustrates as one example that the bar inclined surface 631 is provided in second bar 63.

Second bar 63 is supported by a second bar guider 316 provided in at least one of the outer and inner frames 311 and 312. FIG. 4 (*a*) illustrates as one example that the second bar guider 316 is provided in outer frame 311 to guide the motion of second bar 63.

Meanwhile, second bar 63 is pressed in a direction away from the fourth shaft detaching portion 552 by second supporter 633. One end of the second supporter 633 is fixed to second bar 63 and the other end is fixed to one of the outer and inner frames 311 and 312.

Hereinafter, the transition process of the rotation axes (X and Y) of door 3 will be described.

When door 3 closes laundry introduction hole 111 (i.e., when the door body 31 is in contact with front panel 11 and when handle body 41 is not pressed), first bar 61 is pressed toward first hinge 51 by first supporter 615 and a first free end 61*e* of the first bar prevents first shaft 511*b* from being separated from first shaft accommodating portion 513*b*.

Figure 5:
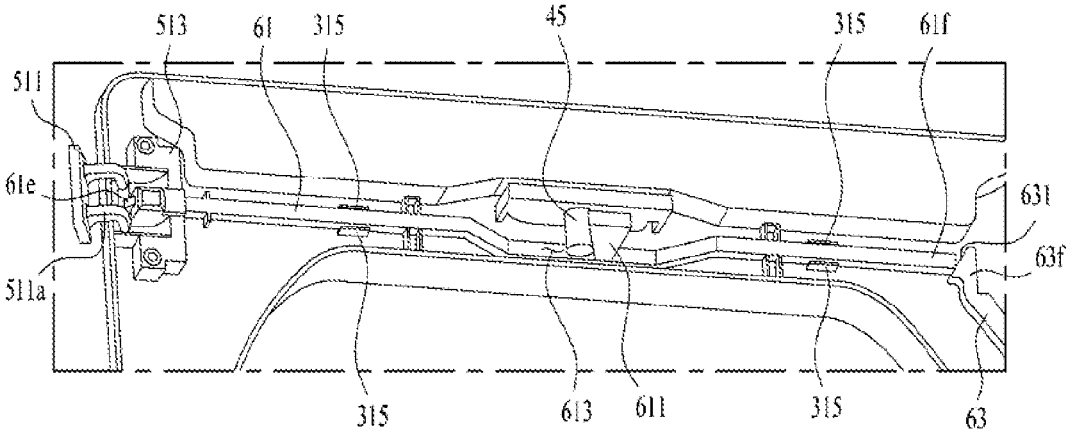
FIG. 5 is a diagram illustrating a process for detaching a first hinge and a first bar.
Figure 5:
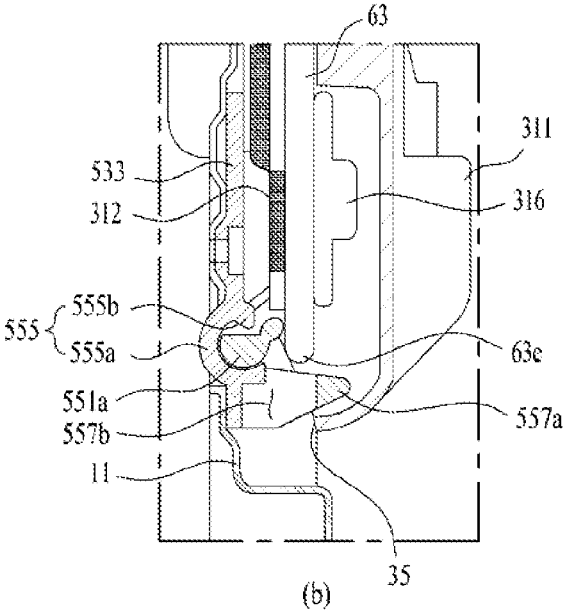

Meanwhile, when door 3 closes laundry introduction hole 111, fourth shaft 551*a* remains inserted in the fourth shaft accommodating portion 555 and the first free end 63*e* of second bar 63 is not inserted in the flange penetrating hole 557*b* as shown in FIG. 5 (*b*). Second bar 63 will not move toward the fourth shaft detaching portion 552, only when not moved in a direction getting far from the first hinge 51 (i.e., to the right in FIG. 5 (*a*)) by the handle 4.

Accordingly, when door 3 closes the laundry introduction hole 111, the door 3 is in a state of being rotatable with respect to the first rotational axis (X) formed by the first shaft 511*b* and the second shaft 531*c*.

When the user pulls door body 31 in a direction away from front panel 11, using handle accommodating portion 314, door 3 is rotated on the first rotational axis (X) to open the laundry introduction hole 111 (see FIG. 3).

Figure 6:
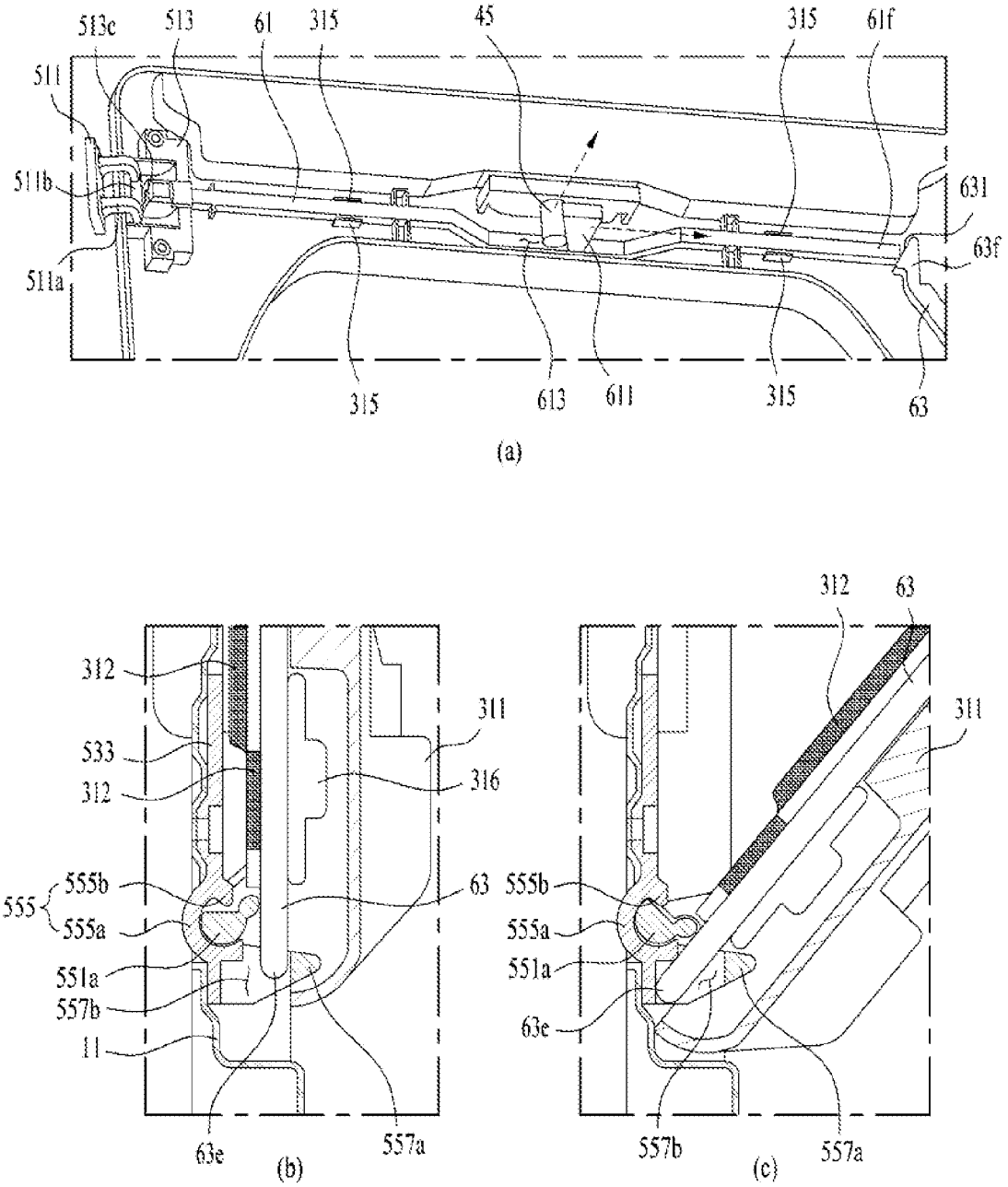
FIG. 6 is a diagram illustrating a process for detaching a third hinge and a second bar.

Meanwhile, when the user presses handle 4 in a state of the door 3 closing the laundry introduction hole 111, first bar 61 and second bar 63 move as shown in FIG. 6.

In other words, the user presses handle body 41 and pressing portion 45 then moves toward the inner frame 312, only to press the inclined surface 6113 provided in the contact portion 611. Accordingly, first bar 61 moves toward second bar 63.

When first bar 61 moves toward second bar 63, the first free end 61*e* of the first bar moves toward an inside of door body 31 and the second free end 61*f* of the first bar presses the inclined surface 631 of the second bar 63.

When the first free end 61*e* of the first bar 61 moves toward the inside of door body 31, the first shaft 511*b* is in a state of being detachable from the first shaft accommodating portion 513*b*. When the second free end 61*f* of the first bar 61 presses the bar inclined surface 631, the first fee end 63*e* of the second bar is inserted in the flange penetrating hole 557*b* of the third hinge 55 and the fourth shaft 551*a* is prevented from being separated from the fourth shaft accommodating portion 555 (see FIG. 6 (*b*)).

Accordingly, when the user presses handle body 41 in a state where door 3 closes laundry introduction hole 111, door 3 is in a state of being rotatable on the second rotation axis (Y) formed by the fourth shaft 551*a* and the third shaft 533*c* (the state shown in FIG. 1).

Once the user pulls door body 31 in the direction away from front panel 11 in a state of pressing handle body 41, door 3 is rotated on the second rotational axis (Y) and opens the laundry introduction hole 111 (see FIG. 6 (*c*)).

Meanwhile, when door body 31 is rotated on the second rotational axis (Y), the laundry treatment apparatus 100 having only the structure mentioned above has to keep the state of pressing handle body 41 to prevent the fourth shaft 551*a* from being separated from the fourth shaft accommodating portion 555.

Accordingly, to solve such a disadvantage, laundry treatment apparatus 100 in accordance with the present disclosure may further include a transition unit lock (not shown) locking the location of first bar 61 or the location of handle body 41 (i.e., restricting the first bar or the handle body), when door 3 opens laundry introduction hole 111 (i.e., when the door body is detachedly moved from the front panel).

If the rotational speed of door body 31 is too high in case door body 31 is rotated on the second rotational axis (Y), the hinge unit 51, 53, and 55 of laundry treatment apparatus 100 having the structure mentioned above could be damaged by the weight of door body 31.

To solve such a disadvantage of damage, a damper 8 may be further provided in the laundry treatment apparatus to adjust the speed of the falling door body 31.

Figure 7:
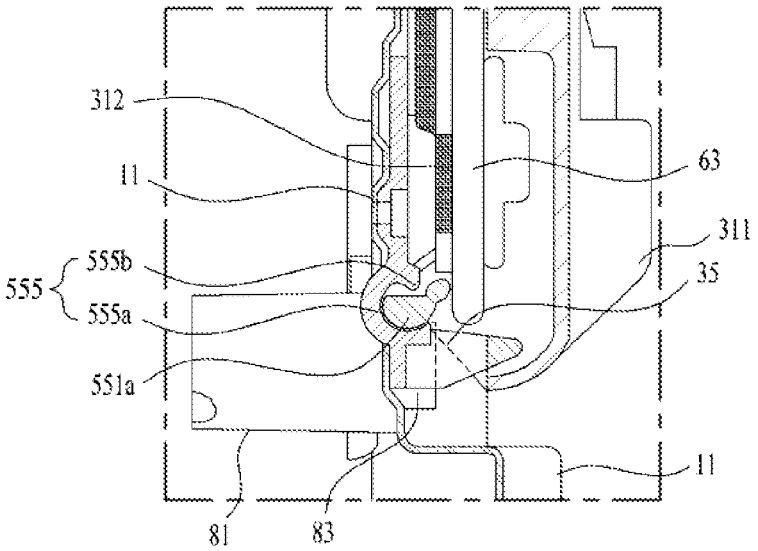
FIG. 7 is a diagram illustrating a damper provided in the laundry treatment apparatus in accordance with the present disclosure.
Figure 7:
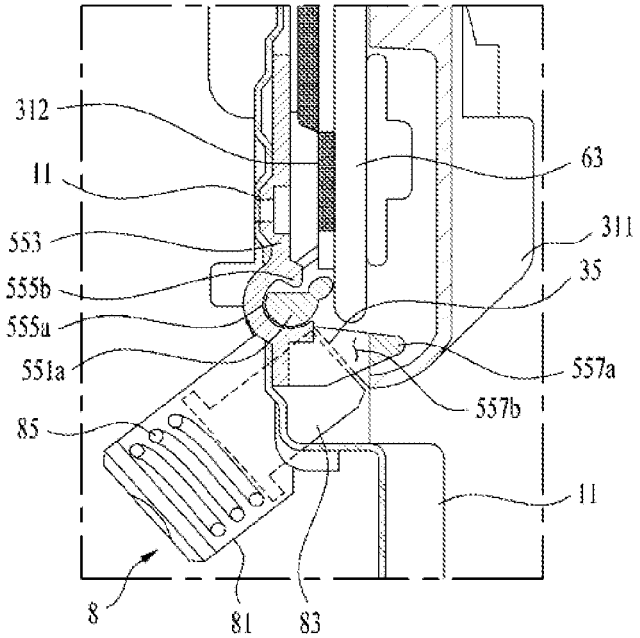

As shown in FIG. 7, damper 8 in accordance with the present disclosure may include a damper housing 81 fixed to front panel 11, a piston 83 provided in the damper housing to reciprocate, in contact with door 3, and a piston supporter 85 provided in damper housing 81 to support piston 83.

Damper housing 81 is fixed to a rear surface of front panel 11, located in cabinet 1. Piston 83 supports door body 31 located in front of front panel 11, penetrating front panel 11.

Piston supporter 85 may be provided in various types, to provide piston 83 with a force of restitution. In FIG. 7 (*a*), piston supporter 85 is a compression spring.

Meanwhile, an inclined surface (35, i.e., a door inclined surface) may be further provided in a lower area of one surface of door body 31 to minimize a turning radius of an edge area of door body 31 so as to minimize a gap between door body 31 and front panel 11.

Moreover, inclined surface 35 may be the means for restricting a rotation angle of the door body (i.e., the maximum rotation angle setting means), when door body 31 is rotated on the second axis (Y).

Inclined surface 35 is provided in a lower end of one surface (the inner frame) of the door toward front panel 11 and it is inclined in a direction away from front panel 11.

Moreover, inclined surface 35 is inclined toward the direction away from the front panel 11 with respect to a line in parallel to the inner frame 312 (toward the outer frame) and it may be provided in an overall width direction (W) of the door body.

Damper 8 may be provided to reciprocate piston 83 along a direction perpendicular to inclined surface 35 and a free end of the piston 83 may be in contact with inclined surface 35.

Damper 8 in accordance with the present disclosure may have a structure shown in FIG. 7 (*a*). When piston 83 is provided to reciprocate along a direction perpendicular to inner frame 312 (a horizontal line lying at right angles to the second rotational axis), there may be disadvantages as follows.

In the structure shown in FIG. 7 (*a*), the direction in which the fourth shaft 551*a* is separated from the fourth shaft accommodating portion 555 is equal to the direction in which piston 83 pushes door body 31. Accordingly, there might be a risk of the fourth shaft 551*a* being separated from the fourth shaft accommodating groove 555*a* by a repulsive force of piston 83.

Also in the structure shown in FIG. 7 (*a*), inner frame 312 or inclined surface 35 might fail to press the free end of piston 83, only to slide past when door body 31 is rotated on the second axis (Y). If door body 31 fails to be provided with the supporting of the free end of piston 83 in the rotation of door 3, the rotation speed of door body 31 might increase excessively only to cause damage to the hinge unit 51, 53, and 55.

However, when piston 83 shown in FIG. 7 (*b*) is provided to reciprocate along the direction perpendicular to inclined surface 35 (i.e., when the piston is provided to reciprocate along a direction inclined upward with respect to a horizontal line parallel to a bottom surface of the cabinet, and lying at a right angle to the second rotational axis), the fourth shaft 551*a* may be prevented from being separated from the fourth shaft accommodating groove 555*a*.

Even when the free end of piston 83 is provided to reciprocate along the direction perpendicular to inclined surface 35, a preset distance with door body 31 is kept, without contacting with door body 31, and there is then a period in which door body 31 is rotated with no support from damper 8. Accordingly, the rotation speed of door body 31 might increase excessively and it is preferred that the free end of piston 83 is in contact with inclined surface 35 in a state of the laundry introduction hole 111 being closed by door body 31.

When the free end of piston 83 is spaced apart a preset distance from inclined surface 35, the time point when piston supporter 85 is pressed may be delayed as much as the distance between the free end of piston 83 and inclined surface 35 during the rotation of the door body on the second rotation axis (Y). In contrast, when the free end of piston 83 keeps the contact with inclined surface 35, the rotation of door body 31 and the compression of piston supporter 85 starts simultaneously and then the disadvantage of the excessive rotation speed increase of door body 31 can be prevented efficiently.

Damper 8 mentioned above is described in case it is provided in the laundry treatment apparatus 100 enabling the user to select the rotation axes (X and Y). Accordingly, damper 8 mentioned above may be provided in a laundry treatment apparatus having door body 31 which is rotatable only on the second rotation axis (Y).

Meanwhile, it is preferred that the first rotation axis (X) mentioned above is a vertical axis perpendicular to the bottom surface of the cabinet and that the second rotation axis (Y) is a horizontal axis parallel to the bottom surface of the cabinet. However, the present disclosure may not be limited to the first and second rotation axes (X and Y) and the structure of the rotation axes (X and Y) may be variable.

As mentioned above, the embodiments of the present disclosure may provide the laundry treatment apparatus including the plurality of the rotation axes on which the door can be rotated in different directions.

Furthermore, the embodiments of the present disclosure may provide the laundry treatment apparatus which enables the user to select one of the rotation axes.

Still further, the embodiments of the present disclosure may provide the laundry treatment apparatus which may control the rotation speed of the door to prevent damage to the door supporting means and the other mechanisms.

What is claimed is:

1. A laundry treatment apparatus comprising:

a cabinet forming an exterior appearance of the laundry treatment apparatus including a front panel;

a laundry introduction hole formed in the front panel;

a laundry accommodating unit provided in the cabinet including a predetermined space in which laundry introduced through the laundry introduction hole is held;

a door, coupled to the front panel and rotatable about a horizontal axis parallel to a bottom surface of the cabinet, to open and close the laundry introduction hole; and a damper, provided in the front panel and upwardly inclined with respect to the bottom surface of the cabinet, to elastically support the door, wherein the damper comprises:

a damper housing provided in the front panel;

a piston including one end reciprocating in the damper housing and a free end supporting the door, wherein the free end of the piston is in contact with the door when the door closes the laundry introduction hole; and a piston supporter provided in the damper housing to elastically support the piston.

2. The laundry treatment apparatus of claim 1, wherein the door comprises:

an inclined surface provided in a lower end surface of the front panel, the surface being inclined in a direction away from the front panel, wherein the free end of the piston supports the inclined surface.

3. The laundry treatment apparatus of claim 2, wherein the piston reciprocates in a direction inclined a preset angle with respect to a line parallel to a bottom surface of the cabinet and at right angles to the horizontal axis.

4. A laundry treatment apparatus comprising:

a cabinet forming an exterior appearance of the laundry treatment apparatus including a front panel;

a laundry introduction hole formed in the front panel;

a laundry accommodating unit provided in the cabinet including a predetermined space in which laundry introduced through the laundry introduction hole is held;

a door, coupled to the front panel and rotatable about a horizontal axis parallel to a bottom surface of the cabinet, to open and close the laundry introduction hole; and a damper, provided in the front panel and upwardly inclined with respect to the bottom surface of the cabinet, to elastically support the door, a first hinge comprising a first shaft provided in the front panel to form a vertical axis perpendicular to the bottom surface of the cabinet and a first shaft accommodating portion provided in the door to accommodate the first shaft;

a second hinge comprising a second shaft coupled to the door to form the vertical axis with the first shaft, and a third shaft rotatably coupling the second shaft to the front panel to form the horizontal axis;

a third hinge comprising a fourth shaft provided in the door to form the horizontal axis with the third shaft, and a fourth shaft accommodating portion provided in the front panel to accommodate the fourth shaft;

a first bar reciprocating in the door to open and close the first shaft accommodating portion; and a second bar reciprocating in the door to open and close the fourth shaft accommodating portion when the first bar is moved in a direction to open the first shaft accommodating portion.

5. The laundry treatment apparatus of claim 4, wherein the door further comprises:

an inclined surface provided in a lower end surface of the front panel, the surface being inclined in a direction away from the front panel, wherein the damper supports the inclined surface.

6. The laundry treatment apparatus of claim 5, wherein the damper comprises, a damper housing fixed to a rear surface of the front panel and inclined a preset angle with respect to a horizontal plane at right angles to the horizontal axis;

a piston reciprocating in a direction perpendicular to the inclined surface; and a piston supporter provided in the damper housing to elastically support the piston.

7. The laundry treatment apparatus of claim 6, wherein the piston includes one end reciprocating in the damper housing and a free end supporting the inclined surface.

8. The laundry treatment apparatus of claim 6, wherein the free end of the piston is in contact with an inclined surface of the door when closing the laundry introduction hole.

9. The laundry treatment apparatus of claim 4, further comprising:

a handle including a handle body, a handle body shaft, a pressure point, and a pressing portion, wherein the handle body shaft is located at one end of the handle body and the pressing portion is located at the opposite end of the handle body with the pressing point lying there between, and wherein operation of the handle requires pressure to be applied to the pressure point.

10. The laundry treatment apparatus of claim 9, wherein operation of the handle causes reciprocation of one or more of the first bar and the second bar.

11. The laundry treatment apparatus of claim 9, wherein the handle is included in a handle accommodating portion located in the door.

12. The laundry treatment apparatus of claim 4, further comprising:

a handle including a handle body, a handle body shaft, a pressure point, and a pressing portion, wherein the pressing point is located at one end of the handle body and the pressing portion is located at the opposite end of the handle body with the handle body shaft lying there between, and wherein operation of the handle requires pressure to be applied to the pressure point.

13. The laundry treatment apparatus of claim 12, wherein operation of the handle causes reciprocation of one or more of the first bar and the second bar.

14. The laundry treatment apparatus of claim 12, wherein the handle is included in a handle accommodating portion located in the door.

* * * * *